US007663075B2

(12) United States Patent
Lee et al.

(10) Patent No.: US 7,663,075 B2
(45) Date of Patent: Feb. 16, 2010

(54) LAYER FOR USE IN A DOMESTIC APPLIANCE

(75) Inventors: Poh Loo Lee, Singapore (SG); Gerard Cnossen, Drachten (NL); Marcel Rene Boehmer, Eindhoven (NL); Sandor Nemeth, Singapore (SG); Pieter Johannes Werkman, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 331 days.

(21) Appl. No.: 11/596,826

(22) PCT Filed: May 13, 2005

(86) PCT No.: PCT/IB2005/051579

§ 371 (c)(1),
(2), (4) Date: Nov. 16, 2006

(87) PCT Pub. No.: WO2005/115056

PCT Pub. Date: Dec. 1, 2005

(65) Prior Publication Data

US 2007/0228033 A1 Oct. 4, 2007

(30) Foreign Application Priority Data

May 19, 2004 (SG) ..... SG04/00139

(51) Int. Cl.
*H05B 3/16* (2006.01)
*B05D 3/12* (2006.01)

(52) U.S. Cl. ..... 219/543; 219/544; 219/547; 219/548; 427/387; 427/388.1; 427/419.2; 427/419.7; 428/561; 428/560; 428/562; 428/497

(58) Field of Classification Search ..... 219/543–4, 219/547–8; 427/387, 388.1, 419.2, 419.7; 428/561, 560, 562, 497
See application file for complete search history.

(56) References Cited

U.S. PATENT DOCUMENTS

| | | | |
|---|---|---|---|
| 4,670,299 | A | 6/1987 | Fukuyama et al. |
| 5,822,675 | A | 10/1998 | Paquet et al. |
| RE36,573 | E | 2/2000 | Barrow et al. |
| 6,284,682 | B1 | 9/2001 | Troczynski et al. |

FOREIGN PATENT DOCUMENTS

| | | | |
|---|---|---|---|
| EP | 0954201 | A2 | 11/1999 |
| EP | 0964410 | A2 | 12/1999 |
| EP | 0967838 | A1 | 12/1999 |
| WO | 2002072495 | A2 | 9/2002 |
| WO | 02/085072 | * | 10/2002 |
| WO | WO 02/085072 | | 10/2002 |
| WO | WO 2004/022660 | | 3/2004 |

OTHER PUBLICATIONS

Jeffrey Brinker et al; "Sol-Gel Science", Gulf Professional Publishing, 1990, ISBN 0121349705, 9780121349707, pp. 112-116.
Journal of the Danish Ceramic Society vol. 5, No. 1, 2002, "Applications of Composite Sol-Gel Coatings", pp. 3-6.

* cited by examiner

*Primary Examiner*—Shawntina Fuqua

(57) ABSTRACT

Disclosed is a layer for use in a domestic appliance, based on a sol-gel precursor. This layer can be obtained by screen-printing and comprises an organosilane compound. The layer is obtained from a concentrated pre-polymerized sol-gel precursor. The layer can be used as an insulating layer or as a conductive layer in a heating element. Furthermore, the layer can be used for decorative purposes.

14 Claims, No Drawings

LAYER FOR USE IN A DOMESTIC APPLIANCE

The present invention relates to a layer for use in a domestic appliance based on a sol-gel precursor. Furthermore, the present invention relates to a heating element at least comprising an insulating layer and a resistive layer, in which at least one of said layers comprises a sol-gel based layer according to the invention. The present invention also relates to a domestic appliance with a surface layer comprising the sol-gel based layer according to the present invention.

The layer according to the present invention should be suitable for both high and low voltage applications. The layers disclosed are very suitable for insulating, resistive, and decorative layers in laundry irons, especially for the controlled formation of steam, for which high power densities (>20 W/cm$^2$) are required.

In the manufacturing of flat heating elements, insulating and conducting layers based on sol-gel materials are applied on a substrate. Spray coating is a common way for the application of these layers, especially for the insulating layer. Also for decorative purposes spray coating is very common. However, in order to control the thickness of the layer accurately, it is desirable to use more accurate techniques.

The present invention provides a layer for use in a domestic appliance that is based on a sol-gel precursor and can be applied by screen-printing and comprises an organosilane compound. Such a sol-gel based layer can be used as an insulating and conductive layer of a heating element or for decorative purposes. A preferred substrate for application of the layer according to the invention is aluminum, which can be anodized prior to the deposition of the insulating layer to ensure good adhesion.

In order to provide a sol-gel based layer by means of screen-printing, the layer according to the present invention is obtained from a concentrated prepolymerized sol-gel precursor.

By using such concentrated prepolymerized sol-gel precursor the amount of shrinking of the sol-gel precursor composition is reduced considerably compared to the use on a non-concentrated non-prepolymerized sol-gel precursor. The reduced amount of shrinking permits the use of the accurate screen-printing technique to apply the layer to a substrate.

It is noted that the pre-polymerized sol-gel precursors comprise several different compositions. In order to clearly define the compositions, they are defined as mono-substituted organosilanes, $(Si—O_x—R_y)_n$ with y=1 and n>1 that can be derived from sol gel precursors or are commercially available under tradenames such as Silres (Wacker, Silres610). For good thermal stability R is preferably a methyl or a phenyl group. In the presence of aluminum, methyl groups have to be chosen for good thermal stability. Small amounts (<10%) of components with the composition $(Si—O_x—R_y)$ with y=2 or y=0 or $(Si—O_x—R1_yR2_z)$ with y=z=1 and R1 and R2 being different organic groups, can be present in the organosilane.

In a preferred embodiment, the prepolymerized sol-gel precursor at least comprises an organosilane compound and a solvent.

In order to delimit the amount of shrinkage, the amount of solvent present is less than 40%. However, in a more preferred embodiment, the amount of solvent is 15-25%.

In an advantageous embodiment of the present invention the layer forms an insulating layer of a heating element.

In general a (flat) heater system comprises two functional layers applied on a substrate, namely an electrically insulating layer and an electrically conductive layer. The electrically conductive layer in the above-mentioned heating element generally comprises a layer with a high ohmic resistance, the resistive layer, as well as a layer with a lower ohmic resistance, which acts as a contact layer. Heat is generated by passing an electric current through the resistive layer. The function of the insulating layer is to isolate the heat-generating resistive element from the substrate, which may be directly accessible from the outside.

Insulating layers for heating elements are relatively thick compared to low voltage insulation for electronics applications, see for instance U.S. Pat. No. 4,670,299, where a thickness up to only a few micrometers is required. For insulating layers in flat heating elements sol-gel layer thicknesses up to about 50 μm are disclosed in e.g. WO02/085072, while layer thicknesses between 150 and 500 μm are disclosed in WO02/072495. To make such thick sol-gel layers, the shrinkage in the drying and curing step has to be minimized. To those skilled in the art a well-known way of reducing the shrinkage is to add particles to the sol gel system.

In a preferred embodiment the layer thickness of the insulating layer is in the range of 25 to 100 μm, preferably 35 to 80 μm. With this relatively small layer thickness for an insulating layer of a heating element, for instance compared to those disclosed in WO02/072495, the temperature drop over the insulating layer is limited. This allows the track temperature to be fairly low for a 50 μm insulating layer. For a specific, high power density application of 50 W/cm$^2$ which requires a heating face temperature of 250° C., a conductive track temperature of only 320° C. is required. On the contrary, for an insulating layer thickness of 300 μm a track temperature of 600° C. would be required, which is beyond the thermal stability of many materials that can potentially be used for this track and poses more constraints on thermal expansion. Relatively thin, i.e. about 50 μm thick, insulating layers can only provide sufficient insulation if they are essentially non-porous. The insulating layers comprising the layer according to the present invention are so dense that they have a dielectric strength of about 100 kV/mm.

The present invention thus also relates to a heating element at least comprising an electrically insulating layer and an electrically conductive layer, wherein the electrically insulating layer comprises a layer according to the present invention as disclosed in the above.

The present invention relates to a heating element, which is made of an insulating layer made from pre-polymerized precursors, which can be concentrated to make them suitable for (screen-) printing of insulating layers of flat heating elements.

Advantageously, the electrically insulating layer comprises non-conductive particles.

A fraction of said non-conductive particles preferably have a flake-like shape and a longest dimension of 2-500 micrometers, preferably from 2-150 micrometers, and more preferably from 5-60 micrometers. These flake-like non-conductive particles are based on oxidic materials such as, for example, mica, or clay, and/or surface-modified mica or clay particles with a coating of titanium dioxide, aluminum oxide and/or silicon dioxide. The flake-like material content in the insulating layer should be less than 20%, preferably less than 15%, and more preferably 4-10% by volume.

Preferably, the electrically insulating layer comprises anisotropic, non-conductive particles.

An advantage of such anisotropic particles (e.g. mica and iriodin 123) is that their presence prevents the formation of cracks in the electrically insulating layer after frequent heating up and cooling down of the heating element.

In a further preferred embodiment of the present invention, the layer according to the present invention forms an electrically conductive layer of a heating element.

The resistive track of the present invention which is applied on the insulating layer relates to a layer made from sol-gel or pre-polymerized sol-gel precursors, which are filled with conductive particles in order to obtain a conductive layer.

The invention relates to a heating element as disclosed in the above, wherein the electrically conductive layer comprises a layer according to the present invention.

In a preferred embodiment, the electrically conductive layer comprises conductive and/or semi-conductive particles, as well as a number of insulating particles in a quantity of 0-20% by volume.

The resistive layer in the preferred embodiment is made from sol gel or pre-polymerized sol-gel precursors, preferably filled with conducting particles such as graphite or silver or metal-coated particles. By adjusting the particle volume fraction the resistance of the printed layer can be set to a desired value. Particle sizes are preferably below 10 μm and flake and sphere-shaped particles are preferred. Layer thicknesses in a single screen-printing step can be larger than 10 μm, typically 15 μm.

The drying and curing shrinkage can be reduced through an additional concentration step by evaporation, for instance by means of distillation of a hydrolyzed and partially condensated (pre-polymerized) sol-gel solution. Such a concentration step can be performed for many sol gel precursors, for instance, methyltrimethoxysilane used for dielectric films as disclosed in U.S. Pat. No. 4,670,299 and for aluminumisopropoxide as disclosed in U.S. Pat. No. 6,284,682.

To further reduce porosity in the layer, it is particularly advantageous if the sol-gel material is in a liquid phase until all solvent is evaporated during the drying and curing steps. The melting depends on the molecular weight and molecular structure of the pre-polymerized sol-gel materials, as disclosed for MTMS in U.S. Pat. No. 4,672,099. If the sol-gel materials are in the molten state the solvent can easily evaporate and layers that are formed have minimal residual stress resulting from drying and curing.

An additional requirement is that the coefficient of thermal expansion (CTE) of the deposited and cured layer should match that of the substrate. Preferred substrates for flat heating elements have a fairly low CTE, with aluminum substrates being the highest with about 25 ppm/K. Although CTE values of the layers may depend on the curing conditions, the most convenient way to control the CTE of the coating is to incorporate additional components, such as ceramic powders to the sol-gel resin.

Ceramic powders such as alumina, silica, boron nitride, silicon carbide and others have a low CTE, generally below 10 ppm/K. These materials can advantageously be mixed into the coating composition to reduce the CTE to levels comparable to that of the substrate. The optimum amount of the ceramic particle filler would depend on the CTE of the substrate. However, it is generally in the range of 10% to 60% by volume in the cured coating. In addition to the effect of reducing the CTE of the coating, for application in a flat heater the particles must also be insulating and heat-resistant. The shape and size of the particles are not crucial. However, the particle size should be significantly smaller than the intended coating thickness (approximately 5 times less or smaller). The choice of particles with a high aspect ratio, although not essential, can help reduce the cracking tendency. Combining plate-like particles with nearly spherical ones can make especially useful compositions. This combination allows an easier control of CTE than using plate shaped particles alone. Such plate shaped particles can be mica platelets or mica platelets coated with another ceramic material.

The layer according to the present invention is thus very suitable for insulating, resistive and decorative layers in laundry irons, especially for the controlled formation of steam, for which high power densities are required. Additionally, the compositions are also very suitable for other domestic appliances like hair dryers, hair stylers, steamers and steam cleaners, garment cleaners, heated ironing boards, facial steamers, kettles, pressurized boilers for system irons and cleaners, coffee makers, deep fat fryers, rice cookers, sterilizers, hotplates, hot-pots, grills, space heaters, waffle irons, toasters, ovens or water flow heaters.

In U.S. Pat. No. 5,822,675 a heating element made from pre-polymerized sol-gel precursors is disclosed. The different layers were cured in the range of 150° C. to 350° C. for 1 to 4 hours. Examples show that these heating elements are able to generate power densities of 20 W/cm$^2$. In the examples shown a methyl phenyl silicone resin was used as binder material for the different layers (insulating, resistive and conductive layers). For the insulating layer, alumina and silica were used as filler material, whereas for the resistive layer a mixture of graphite and carbon black was used. The conductive layer used silver as filler material.

The present invention proposes the use of a sol-gel precursor-based concentrated pre-polymerized binder as the major coating component for the insulating layer. The binder is based on sol-gel precursors that form heat-resistant polymers. These include tetraethylorthosilicate and methyltri(m)ethoxysilane. These precursors can be reacted with water in the presence of an acid or a base catalyst to form reactive silanol groups. The silanol groups can then react with each other to provide oligomeric and polymeric binder materials. These condensation reactions may be accelerated by acids and by strong bases. The precursors can be used individually to form a homopolymer or they can be combined to form a copolymer. Alternatively, commercially available polymers based on the listed components can be used in the present formulation.

The pre-polymerized binder material can be dissolved in a suitable solvent. Appropriate solvents are alcohols, ether-alcohols, ketones, ethers and aromatic solvents. Considering solubility, solvent toxicity and flammability, the most advantageous solvents are ketones, such as methylethylketone, methylisobutylketone, diisobutylketone and others. Alcohols and ether-alcohols tend to be poor solvents for these polymers. Ethers such as diethylether, tetrahydrofurane and others can be good solvents for the polymer but they are generally highly flammable and prone to the quick formation of explosive peroxides. Aromatic solvents such as benzene, toluene and xylenes are good solvents for the polymer but they tend to have severe health effects. For screen-printing applications a high boiling point solvent is necessary to minimize the drying of the coating composition on the printing screen. For this, methylisobutylketone and diisobutylketone were found adequate.

The dissolved prepolymer can be combined with the appropriate filler particles and a dispersion can be formed by ball milling or high speed dispersing. The dispersion can be used directly for the coating applications or the amount and type of solvent can be varied by addition of solvents or by distilling out some of the solvents. For screen-printing applications, it was found that pre-polymers containing sufficient amount of filler and solvent could be used directly without additional viscosity modification (for example 50% alumina with 0.5 μm average size, 25% pre-polymer and 25% solvent). This is advantageous as no additive has to be burned out, which, depending on its decomposition temperature, might lead to porosity of the layer. However, if desired, the viscosity can be modified with rheological additives that are compatible with the carrier solvents. Addition of this rheology modifier can increase the viscosity at low shear rates and can thus prevent the coating composition from seeping through the screen-printing mesh. These additives also prevent the settling of filler particles upon storage.

The compositions used in the present invention—pre-polymerized sol-gel materials which include tetraethylorthosilicate and methyltri(m)ethoxysilane (homo and co-polymers)—show an increased thermal stability compared with methyl phenyl silicone resins shown in the examples of U.S. Pat. No. 5,822,675. In the presence of alumina, the phenyl group of the methyl phenyl silicone is split up at temperatures below 200° C. in air, whereas without the presence of alumina, the material remains thermally stable up to at least 400° C. in air. Therefore, insulating layers made from pre-polymerized sol-gel materials which include tetraethylorthosilicate and methyltri(m)ethoxysilane (homo and co-polymers, Silres610 from Wacker) with alumina fillers show an increased moisture resistance compared with methyl phenyl silicone based insulating layers with alumina fillers.

In the final formulation the amount of solvent should be kept low, to minimize the porosity. Typical values are 15-25% and the amount of solvent should not exceed 40% for screen-printing applications. Solvent-free compositions can also be prepared. However, these compositions have to be applied as hot-melt coatings, typically at temperatures above 100° C.

The coating formulation of these insulating layers can be deposited by many methods including spraying, dipping, spin coating and especially screen-printing. The deposited coating has to be dried at a temperature below the boiling point of the applied solvent to avoid the formation of bubbles. Subsequently, it has to be thermally cured at a temperature above the intended application temperature and at a maximum of 450° C. Preferably above 400° C. Crack-free, essentially non-porous coatings in excess of 100 μm can be prepared by the disclosed method.

In U.S. Pat. No. 5,822,675 a maximum cure temperature of about 325° C. is used.

In the present invention, curing temperatures above 400° C., preferable above 420° C., are used for the insulating layer. These high curing temperatures, facilitate complete curing/condensation, therefore, during the active use of such a heating element at high power densities (exceeding 20 W/cm$^2$), no post-curing of the resistive track can take place (which may lead to crack formation).

The resistive track of the heating element in the present invention can be made from sol-gel (e.g. MTES, methyltriethoxysilane) or pre-polymerized sol-gel precursors (e.g. Silres610). The filler material is preferably a metal resistant to oxidation such as silver, silver alloys, gold, platinum, palladium or any metal particles coated with the oxidation resistant metals listed above. The conductive particles used can be flakes, spheres or irregular particles.

In U.S. Pat. No. 5,822,675 a mixture of graphite and carbon black was used as filler material and a methyl phenyl silicone resin was used as binder material. The resistive track prepared in this way is less thermally stable than the resistive track used in this invention (with silver as conductive filler material).

The heater described in the present invention can be operated at much higher power densities (up to 100 W/cm$^2$) compared to the heater from U.S. Pat. No. 5,822,675 (max. 20 W/cm$^2$).

The invention is further illustrated in the following examples.

EXAMPLE 1

A commercially available prepolymer, SilRes610 from Wacker, based on MTMS was used. Of the Silres 610, 20.16 g were dissolved in 17.15 g of diisobutylketone and 105.02 g of alumina dispersion was added which was previously prepared by ball milling and contained 39.5% alumina (0.5 μm particle size), 0.4% MTMS, the balance being MEK. The MEK was distilled out under reduced pressure to form a composition of 53.5% alumina, 26.0% prepolymer, 0.6% MTMS and 19.9% diisobutylketone. The composition was suitable for screen-printing without further modification. Layers were printed on an anodized aluminum substrate to form coatings of up to about 88 μm thickness. The layers were cured at 415° C. for 2 hours. The breakdown voltage increased with thickness and reached 4 kV at 54 μm. However, further increase in the thickness reduced the breakdown voltage. The dielectric strength decreased somewhat with increasing thickness and it was in the range of 7-13×10$^7$ V/m (70-130 kV/mm) for layers up to 54 μm.

A further paste was prepared by adding Iriodin 123 powder to the paste described above. Iriodin is a pearlescent pigment made of mica and a titanium dioxide thin layer coating. The particle size is in the range of 5-25 μm and the shape is highly anisotropic, predominantly lamellar. The Iriodin 123 powder was mixed in the paste by mechanical stirring to form a composition of 49.1% alumina, 8.2% Iriodin 123, 23.8% SilRes 610, 0.6% MTMS and 18.3% DIBK. Layers were printed on an anodized aluminum substrate to form coatings of up to about 103 μm thickness. The layers were cured at 415° C. for 2 hours. The breakdown voltage increased with thickness and reached over 4 kV at 54 μm. This high breakdown voltage was maintained for all the thicker samples. The dielectric strength at 54 μm was 7.6×10$^7$ V/m (76 kV/mm).

EXAMPLE 2

A composition of 40.95 g of SilRes610 dissolved in 24.60 g of diisobutylketone (DIBK) was prepared and 140.08 g of alumina dispersion were added, which was previously prepared by ball milling and contained 39.5% alumina (0.5 μm particle size), 0.4% MTMS, the balance being MEK. The MEK was distilled out under reduced pressure to provide a composition of 45.1% alumina, 33.5% SilRes610, 0.5% MTMS, 20.9% DIBK. The viscosity of the composition had a moderate shear rate dependence with values of 1.7 Pas at 100 s$^{-1}$ and 2.1 Pas at 20 s$^{-1}$. The paste was used for the preparation of screen-printed insulating layers on anodized aluminum. The layers were cured at 415° C. for 2 hours and had a dielectric strength of 63 kV/mm at 27 μm thickness.

The paste described above was further modified by adding a freshly prepared solution of BYK-410 (from BYK Chemie, 3.5% dissolved in methylisobutylketone). The paste with the added BYK solution was further distilled and additional DIBK was added to obtain a composition of 43.4% alumina, 32.2% SilRes610, 0.4% MTMS, 0.42% BYK-410, and 23.6% DIBK. The viscosity of the composition had a strong shear rate dependence with values of 1.8 Pas at 100 s$^{-1}$ and 3.0 Pas at 20 s$^{-1}$. The paste was used for the preparation of screen-printed insulating layers on anodized aluminum. The layers were cured at 415° C. for 2 hours and had a dielectric strength of 106 kV/mm at 26 μm thickness.

EXAMPLE 3

A commercially available prepolymer, SilRes610 from Wacker was used. Of the Silres 610, 69.93 g were mixed with 137.00 g of alumina powder (CR6 from Baikowski Chimie), 42.71 g of diisobutylketone and 111.50 g of acetone. The mixture was milled with 137 g of 3 mm diameter glass beads for two days. The beads were separated and the remaining dispersion was distilled under vacuum at 80° C. bath temperature to remove the acetone. The composition of the resulting mixture was adjusted with diisobutylketone and Iriodin 123 (a pearlescent pigment made of mica and a titanium dioxide thin layer coating, available from Merck) to form the following final composition in weight %: 52.02% alumina, 5.24% Iriodin 123, 26.55% Silres 610, and 16.19% diisobutylketone.

The composition was suitable for screen-printing without further modification. Layers were printed on anodized aluminum substrates using a 325 mesh screen to form coatings with varied thickness. The layers were dried at 80° C. for at least 20 minutes, heated to the curing temperature at 7° C./min rate and cured at 422° C. for 15 minutes. The breakdown voltage increased with thickness and reached 5 kV at about 50 μm thickness. The dielectric strength was approximately 100 kV/mm for layers up to 50 μm.

EXAMPLE 4

A commercially available prepolymer, SilRes610 from Wacker was used. Of the Silres 610, 30.52 g were mixed with 50.0 g of aluminum nitride powder (Aldrich), 19.00 g of diisobutylketone and 43.67 g of acetone. The mixture was milled with 55 g of 3 mm diameter glass beads for three days.

After the milling is completed, the jar is removed from the mill and 6.02 g of Iriodin 123 (a pearlescent pigment made of mica and a titanium dioxide thin layer coating, available from Merck) are added. The jar is sealed once again and shaken a few times. Subsequently, the jar is placed once again into the mill where it remains for one minute only. After this the glass beads are separated using a mesh filter and the liquid contents are transferred to a round flask. The flask is attached to a rotational evaporator where the whole (quantitatively) amount of acetone and some amount of DIBK is removed. The evaporation is carried out under increasing temperature up to 90 deg C. and decreasing pressure down to 80-25 mm Hg if necessary to achieve the planned solids concentration of 82 wt % solid content.

The composition was suitable for screen-printing without further modification. Layers were printed on aluminum substrates using a 325 mesh screen to form coatings with varied thickness. The layers were dried at 80° C. for at least 20 minutes, heated to the curing temperature at 5° C./min rate and cured at 430° C. for 360 minutes. The breakdown voltage increased with thickness and reached 4 kV at about 60 μm thickness. The coating has a thermal expansion coefficient of 18 ppm/K.

EXAMPLE 5

A commercially available prepolymer, SilRes610 from Wacker was used. Of the Silres 610, 34.34 g was mixed with 28.14 g of aluminum nitride powder (Aldrich), 33.64 g of alumina powder (CR6 from Baikowski Chimie), 22.59 g of diisobutylketone and 51.93 g of acetone. The mixture was milled with 65 g of 3 mm diameter glass beads for three days.

After the milling is completed, the jar is removed from the mill and 6.78 g of Iriodin123 (a pearlescent pigment made of mica and a titanium dioxide thin layer coating, available from Merck) are added. The jar is sealed once again and shaken a few times. Subsequently, the jar is placed once again into the mill where it remains for one minute only. After this the glass beads are separated using a mesh filter and the liquid contents are transferred to a round flask. The flask is attached to a rotational evaporator where the whole (quantitatively) amount of acetone and some amount of DIBK is removed. The evaporation is carried out under increasing temperature up to 90 deg C. and decreasing pressure down to 80-25 mm Hg if necessary to achieve the planned solids concentration of 82 wt % solid content.

The composition was suitable for screen-printing without further modification. Layers were printed on aluminum substrates using a 325 mesh screen to form coatings with varied thickness. The layers were dried at 80° C. for at least 20 minutes, heated to the curing temperature at 5° C./min rate and cured at 422° C. for 30 minutes. The breakdown voltage increased with thickness and reached 4.5 kV at about 50 μm thickness. The coating has a thermal expansion coefficient of 28.2 ppm/K.

EXAMPLE 6

A commercially available prepolymer, SilRes610 from Wacker was used. Of the Silres 610, 185.33 g were mixed with 376.81 g of alumina powder (CR6 from Baikowski Chimie), 135.07 g of diisobutylketone and 310.50 g of acetone. The mixture was milled with 320 g of 3 mm diameter glass beads for three days.

After the milling is completed, the jar is removed from the mill and 53.15 g of Iriodin123 (a pearlescent pigment made of mica and a titanium dioxide thin layer coating, available from Merck) are added. The jar is sealed once again and shaken a few times. Subsequently, the jar is placed once again into the mill where it remains for one minute only. After this the glass beads are separated using a mesh filter and the liquid contents are transferred to a round flask. The flask is attached to a rotational evaporator where the whole (quantitatively) amount of acetone and some amount of DIBK is removed. The evaporation is carried out under increasing temperature up to 90 deg C. and decreasing pressure down to 80-25 mm Hg if necessary to achieve the planned solids concentration of 82 wt % solid content.

The composition was suitable for screen-printing without further modification. Layers were printed on aluminum substrates using a 325 mesh screen to form coatings with varied thickness. The layers were dried at 80° C. for at least 20 minutes, heated to the curing temperature at 5° C./min rate and cured at 430° C. for 30 minutes. The breakdown voltage increased with thickness and reached 5 kV at about 60 μm thickness. The coating has a thermal expansion coefficient of 23.8 ppm/K.

EXAMPLE 7

A heating element was prepared starting with a heating element from an aluminum substrate provided with an insulating layer as described in example 3. A conductive track was printed on this layer in two passes using a paste prepared according to the recipe given below.

A hydrolysis mixture was prepared from 175 grams of methyltriethoxysilane, 106 grams of water, and 0.5 grams of glacial acetic acid. The mixture was stirred continuously for 2 hours. To 282 grams of this hydrolysis mixture 282 grams of commercially available silver flakes were added with a particle size below 20 μm. Subsequently, 282 grams of n-propanol were added to the mixture which was subsequently ball milled for 3 hours on a roller conveyer.

After removal of the balls, 22.56 grams of a 6% hydroxypropylmethylcellulose solution in water were added to 80 grams of the mixture. After mixing a homogeneous paste was obtained which was screen-printed on said insulating sol-gel layer made from pre-polymerized sol-gel precursors. The layer was dried at 80° C. and followed by a second conductive layer that was also cured at 80° C. and the double pass screen-printed layer was subsequently cured at 350° C. A double pass layer had a thickness of about 10 μm and a sheet resistance of about 0.031Ω per square.

The example heating element was connected to a power supply of 230 Volts at a specific power density of 67 Watt/$cm^2$. The temperature of the substrate was adjusted to 160° C. The sample was subjected to an active test cycle (1 hour on and half an hour off) for 600 hours. The sample passed this life test.

EXAMPLE 8

A heating element was prepared starting with a heating element from an aluminum substrate provided with an insulating layer as described in example 3. A conductive track was printed on this layer in two passes using a paste prepared according to the recipe given below.

A hydrolysis mixture was prepared from 165.5 grams of methyltriethoxysilane, 100.5 grams of water, and 0.5 gram of glacial acetic acid. The mixture was stirred continuously for 2 hours. To 282 grams of this hydrolysis mixture 266 grams of commercially available silver flakes were added with a particle size below 20 μm. Subsequently, 266 grams of n-propanol were added to the mixture which was subsequently ball milled for 3 hours on a roller conveyer.

After removal of the balls, 22.56 grams of a 6% hydroxypropylmethylcellulose solution in water were added to 80 grams of the mixture. After mixing a homogeneous paste was obtained which was screen-printed on said insulating sol-gel layer made from pre-polymerized sol-gel precursors. The layer was dried at 80° C. and followed by a second conductive layer that was also cured at 80° C. and the double pass screen-printed layer was subsequently cured at 350° C. A double pass layer had a thickness of about 10 μm and a sheet resistance of about 0.024Ω per square.

The example heating element was connected to a power supply of 140 Volts at a specific power density of 25 Watt/$cm^2$. The temperature of the substrate was adjusted to 230° C. The sample was subjected to an active test cycle (1 hour on and half an hour off) for 600 hours. The sample passed this life test.

EXAMPLE 9

A heating element was prepared starting with a heating element from an aluminum substrate provided with an insulating layer as described in example 3. A resistive track was printed on this layer in one pass using a paste prepared according to the recipe given below.

A silver-based resistive track was prepared by combining 120 g of silver (D25 silver flake from Ferro), 14.95 g of Silres 610 resin, 34.68 g of acetone, and 12.17 g of DIBK followed by 24 hours of ball milling with 120 g of 3 mm glass balls. The milling beads were separated and 158.07 g of the silver dispersion were transferred into a flask followed by vacuum distillation to remove the acetone. Some additional DIBK was added to produce the final composition of 77.62% silver, 9.67% Silres 610, and 12.71% DIBK where the composition was measured in weight %. The paste was used to print resistive tracks of a spiral geometry through a 145 mesh screen. The resistive coatings were dried at 80° C. for at least 40 minutes, heated at 7° C./min to 422° C. and cured at 422° C. for 15 minutes. The resulting track had an average thickness of 25 μm and a resistivity of approximately $2.3\times10^{-5}$ μcm. The coating is useful as a resistive layer in flat heating elements.

The example heating element was connected to a power supply of 220 Volts at a specific power density of 20 Watt/$cm^2$. The temperature of the substrate was adjusted to 230° C. The sample was subjected to an active test cycle (1 hour on and half an hour off) for 600 hours. The sample passed this life test.

The invention claimed is:

1. A layer for use in a domestic appliance, obtained by screen-printing, based on a sol-gel precursor and comprising an organosilane compound, wherein said layer is obtained from a concentrated prepolymerized sol-gel precursor comprising an organosilane compound and a solvent, an amount of solvent being less than 40%.

2. A layer according to claim 1, wherein the amount of solvent is 15-25%.

3. A layer according to claim 1, further comprising an insulating layer of a heating element.

4. A heating element at least comprising an electrically insulating layer and an electrically conductive layer, wherein the electrically insulating layer comprises a layer according to claim 1.

5. A heating element according to claim 4, wherein the electrically insulating layer comprises non-conductive particles.

6. A heating element according to claim 1, wherein the electrically insulating layer comprises anisotropic, non-conductive particles.

7. A layer according to claim 1, further comprising an electrically conductive layer of a heating element.

8. A heating element according to claim 4, wherein the electrically conductive layer comprises a layer according to claim 1.

9. A heating element according to claim 4, wherein the electrically conductive layer comprises conductive and/or semi-conductive particles, as well as an amount of insulating particles in a quantity of 0-20% by volume.

10. A heating element according to claim 4, wherein the electrically conductive layer comprises metal particles.

11. A heating element according to claim 4, wherein the electrically conductive layer comprises silver or silver alloy particles.

12. A heating element according to claim 4, wherein the electrically conductive layer comprises graphite or carbon-black particles.

13. A layer according to claim 1, wherein the layer is a surface layer of a domestic appliance.

14. Domestic appliance comprising a layer according to claim 1, wherein the domestic appliance comprises a hair dryer, a hair styler, a steamer, a steam cleaner, a garment cleaner, a heated ironing board, a facial steamer, a kettle, a pressurized boiler for system irons and cleaners, a coffee maker, a deep fat fryer, a rice cooker, a sterilizer, a hot-plate, a hot-pot, a grill, a space heater, a waffle iron, a toaster, an oven or a water flow heater.

* * * * *